US011077661B2

(12) United States Patent
Kocsis et al.

(10) Patent No.: US 11,077,661 B2
(45) Date of Patent: Aug. 3, 2021

(54) INDUSTRIAL PRINTHEAD

(71) Applicant: Jetronica Limited, Lancashire (GB)

(72) Inventors: Albert Kocsis, Budapest (HU); Alan Hudd, Lancashire (GB)

(73) Assignee: Jetronica Limited, Lancashire (GB)

( * ) Notice: Subject to any disclaimer, the term of this patent is extended or adjusted under 35 U.S.C. 154(b) by 0 days.

(21) Appl. No.: 16/096,142

(22) PCT Filed: Apr. 25, 2017

(86) PCT No.: PCT/GB2017/051145

§ 371 (c)(1),
(2) Date: Oct. 24, 2018

(87) PCT Pub. No.: WO2017/187153

PCT Pub. Date: Nov. 2, 2017

(65) Prior Publication Data

US 2019/0134979 A1 May 9, 2019

(30) Foreign Application Priority Data

Apr. 25, 2016 (GB) ..... 1607165

(51) Int. Cl.
*B41J 2/14* (2006.01)
*B41J 2/04* (2006.01)

(52) U.S. Cl.
CPC ..... *B41J 2/1433* (2013.01); *B41J 2/04* (2013.01); *B41J 2/14201* (2013.01); *B41J 2002/14467* (2013.01); *B41J 2202/02* (2013.01)

(58) Field of Classification Search
None
See application file for complete search history.

(56) References Cited

U.S. PATENT DOCUMENTS

| | | | | |
|---|---|---|---|---|
| 4,414,552 | A | 11/1983 | Bergmann et al. | |
| 5,798,774 | A | 8/1998 | Okada et al. | |
| 6,460,980 | B1 | 10/2002 | Hegedus et al. | |
| 2003/0116642 | A1 | 6/2003 | Williams et al. | |
| 2006/0256168 | A1* | 11/2006 | Einat | B41J 2/14 347/85 |
| 2008/0199981 | A1* | 8/2008 | Haluzak | B41J 2/14233 438/21 |
| 2014/0098163 | A1* | 4/2014 | Reinten | B41J 2/14233 347/47 |
| 2015/0085021 | A1* | 3/2015 | Govyadinov | B05C 5/02 347/63 |

FOREIGN PATENT DOCUMENTS

| | | | |
|---|---|---|---|
| DE | 4128590 | A1 | 3/1993 |
| JP | S55146774 | A | 11/1980 |
| JP | 2008126584 | A | 6/2008 |
| JP | 2011201090 | A | 10/2011 |

OTHER PUBLICATIONS

International Search Report and Written Opinion received in corresponding PCT Application PCT/GB2017/051145, dated Jul. 6, 2017.

* cited by examiner

*Primary Examiner* — Erica S Lin
(74) *Attorney, Agent, or Firm* — Vorys, Sater, Seymour and Pease LLP

(57) ABSTRACT

An industrial printhead comprising an array of piezoactuated flow channel dispensers enclosed in a chamber with a multi-orifice plate allowing fluid exit.

3 Claims, 5 Drawing Sheets

INDUSTRIAL PRINTHEAD

FIELD

The present invention relates to an industrial printhead particularly in the form of a configuration of piezoactuated flow channel depositors to form an array that can be used industrially as a reliable high resolution digital printhead for high viscosity fluids.

BACKGROUND

Piezoactuated needles are known to be useful for the deposition of fluids based on the mechanism described in PCT/HU1999/000015. However, the industrial application of the technology requires that a number of operational characteristics of the system are improved to ensure consistent operation and achieve the resolution required for many applications with a wide range of fluids, including high viscosity fluids.

In this patent we describe a printhead design that overcomes the industrial limitations of the invention described in PCT/HU1999/000015 including the following main elements:

1. Enclosure of the dispensing nozzle in a compartment including a gaseous flow field to: maintain solvent vapour pressure (to minimise evaporation); control dispensed fluid characteristics (direction, droplet size etc.); minimise effect of proximate airflows on dispenser performance
2. A mechanical mechanism to maintain the nozzle condition to minimise clogging and material build-up
3. A development of the flow channel design described in PCT/HU1999/000015 to increase the viscosity range of fluids that can be deposited and improve spatiotemporal control of the dispensed liquid droplets
4. A mechanism to deflect and recirculate the dispensed fluid if its deposition is not required (in continuous flow mode)

We describe the invention of an industrial printhead configuration that overcomes the limitations of the configuration described in PCT/HU1999/000015 to generate a novel and industrially applicable embodiment of piezo actuated flow channel deposition principle.

SUMMARY

An aspect of the invention provides an industrial printhead comprising an array of piezoactuated flow channel dispensers enclosed in a chamber with a multi-orifice plate allowing fluid exit.

Configuration of piezoactuated flow channel depositors to form an array that can be used industrially as a reliable high resolution digital printhead for high viscosity fluids. In order to implement piezoactuated flow channels depositors for reliable industrial use at a suitable resolution for coding and marking and with a wide range of fluids, including high viscosity, several limitations were overcome with the disclosed printhead design that achieve the following improvements: i) Minimising clogging of the dispenser orifices; ii) Increasing the achievable resolution to >5 dpi; iii) Dispensing high viscosity fluids>1000 cposie.

Another aspect of the invention provides a tapered dispenser flow channel wherein the cross section at the inlet is circular with a diameter of >10 mm and tapers to a circular outlet of diameter 5 mm.

Another aspect of the invention provides a locally controlled temperature flow channel tip for control of liquid deposition.

FIGURES

Figure 8:
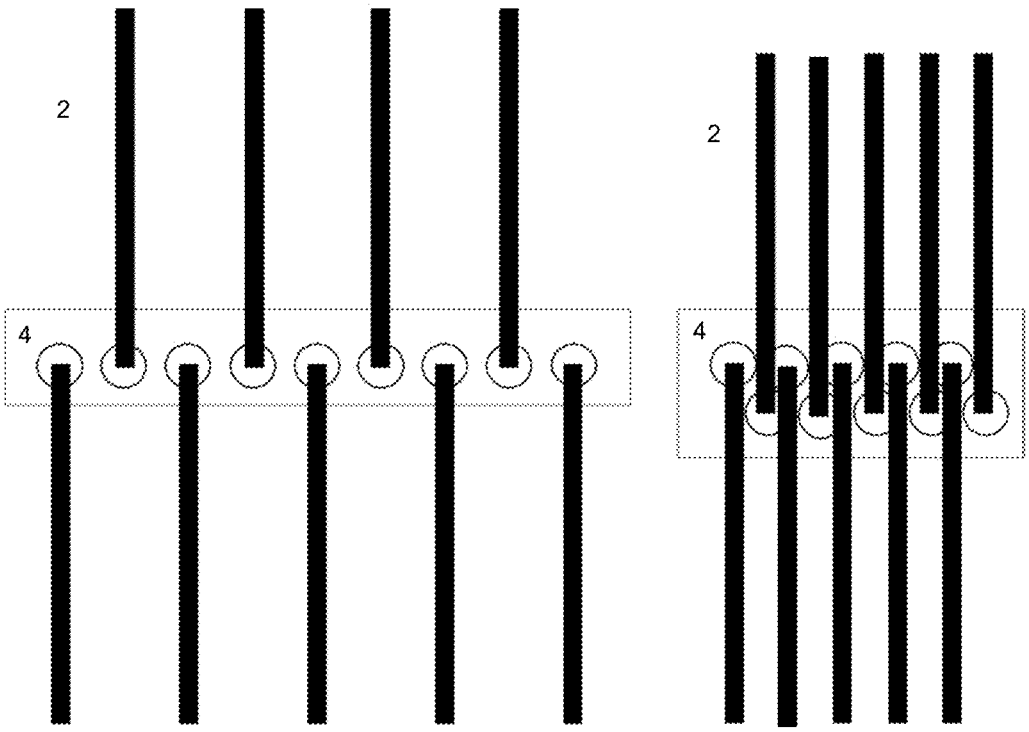
Figure 9:
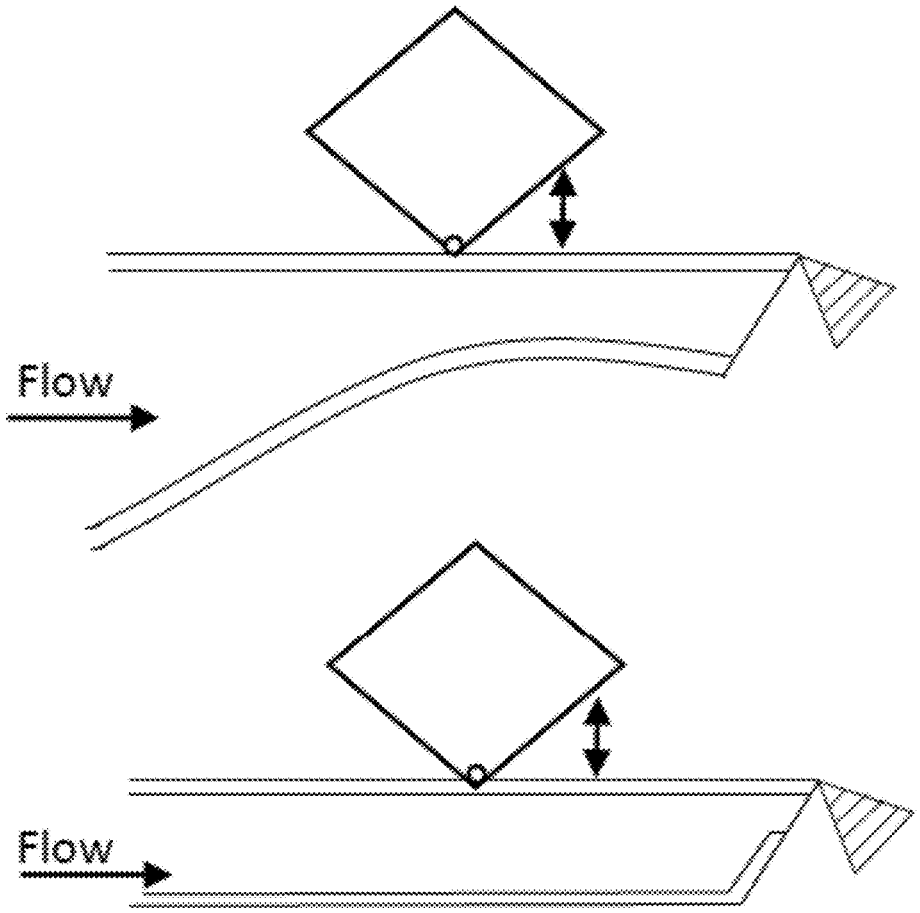
Figure 10:
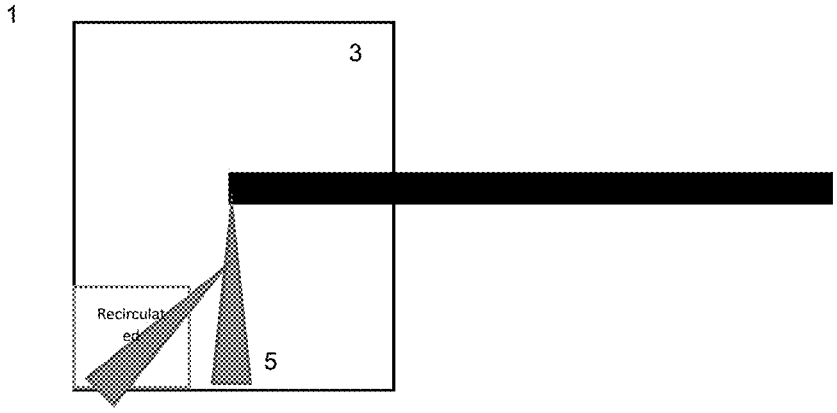

FIG. 8 shows an interdigitated array of dispenser nozzles to achieve a high resolution printhead configuration. Left—non-overlapped nozzle plate orifices. Right overlapped nozzle plate orifices;

FIG. 9 shows tapered flow channels to reduce flow resistance to high viscosity fluids;

FIG. 10 shows piezo re-directed fluids flow.

DESCRIPTION

The printhead 1 design described includes an array of flow channels 2 entering a gas-filled chamber 3 that encapsulates the flow channel orifices and acts to manage the fluids that exit the flow channel such that they can be deposited onto a substrate more reliably, at higher resolution and using higher viscosity fluids than an array of flow channels 2 alone.

The chamber design is at the core of this invention and comprises a gas filled headspace, an array of secondary orifices and a means to insert the flow channels into the chamber 3. A key element of the invention is the geometry of the chamber 3 and the position of the flow channels relative to the chamber nozzle plate orifices and internal structures to direct gas flow in the chamber 3.

In addition, we describe improvements to the flow channels themselves to enhance performance compared to the flow channels described in (previous patent).

Figure 1:
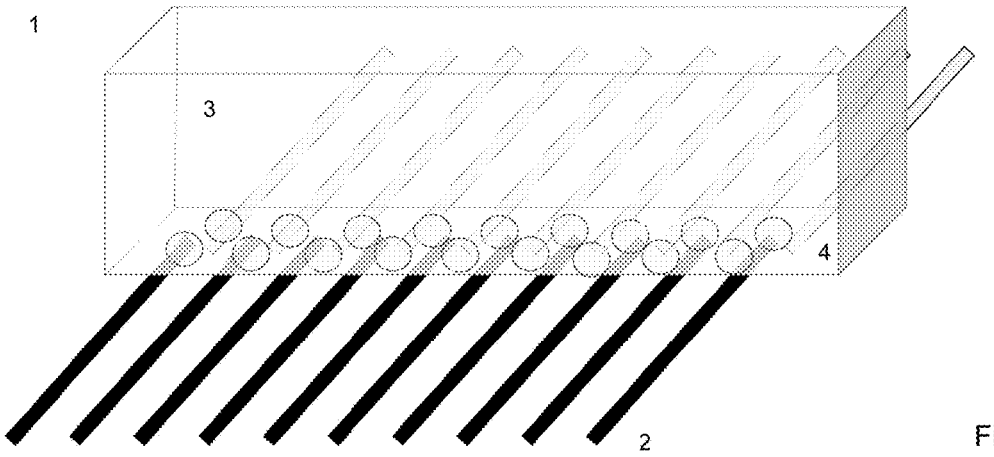
FIG. 1 shows a 3D View of a Printhead design according to aspects of the invention.
Figure 2:
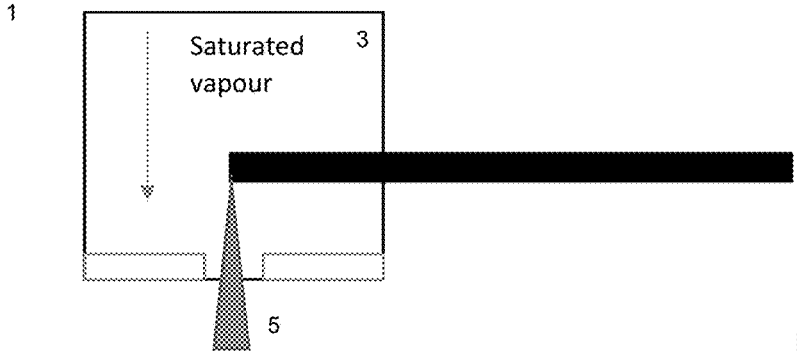
FIG. 2 shows an example of a multi-orifice plate chamber printhead design—saturated solvent vapour in dispenser chamber.
Figure 3:
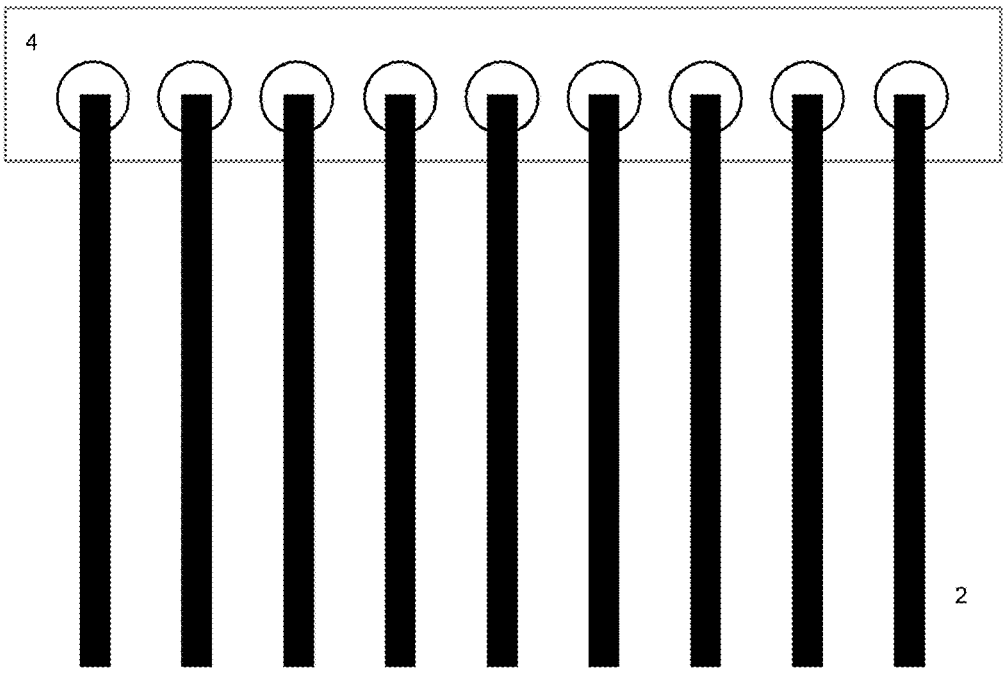
FIG. 3 shows a plan view of a multiple orifice nozzle plate design.

FIGS. 2 and 3 illustrate a first example defining a chamber 3 filled with solvent-saturated vapour: a) the flow channel enclosure is filled with gas to create a solvent saturated environment; b) the flow channel dispense orifice is maintained in an environment of the solvent at saturated vapour pressure, therefore evaporation at the tip in minimised and clogging due to evaporation of the deposition solution solvent is also minimised; c) the saturated gas is introduced into the chamber 3 as a continuous flow; and d) the flow of gas may also direct the dispensed fluid.

Figure 4:
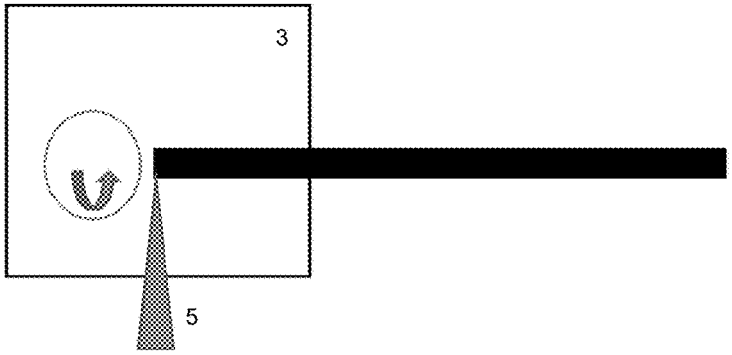
FIG. 4 shows a side view of a rotating brush nozzle cleaner.

FIG. 4 illustrates a second example defining a nozzle cleaning system comprising a rotating brush assembly within a nozzle enclosure. The brush is designed to be brought into contact with the nozzle tip periodically to remove material build-up.

Figure 5:
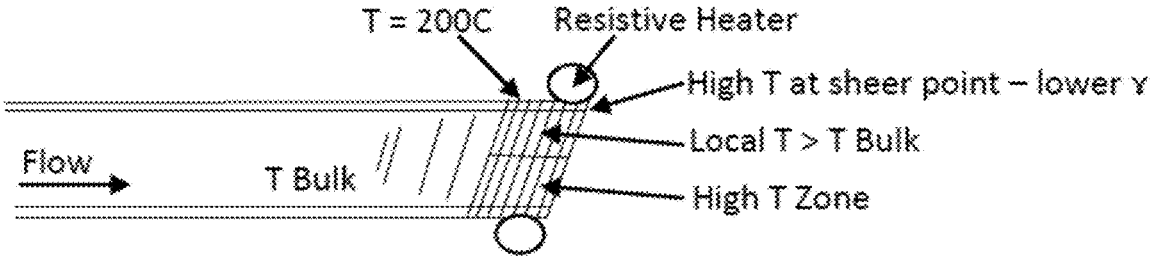
FIG. 5 shows a heated nozzle tip to control meniscus and droplet formation.

FIG. 5 illustrates a third example defining a locally heated nozzle. Heated nozzle tips to minimise material build-up at the nozzle. A resistive heating element is integrated with the flow channel to deliver a locally increased temperature at the nozzle tip. Piezo-actuated liquid deposition is based on breaking the surface tension of a liquid using high shear forces at a needle orifice. Control of the surface tension is therefore, a key element in achieving consistent deposition of liquids.

Since surface tension is a function of temperature and generally decreases with increasing temperature, the temperature at which the high shear droplet formation process occurs is found to be important. In this invention we describe a design in which the temperature of the tip of the needle is locally controlled in order to provide localised control of the surface tension of the liquid without changing the liquid bulk temperature.

The bulk temperature of the fluid can be controlled, however for many materials it is not desirable to use elevated temperatures due to materials stability.

This invention is also capable of delivering localised heating such that thermal evaporation may occur alongside high shear droplet formation to create an additional process for droplet formation at the orifice.

A fourth example defines a piezo pulse pattern to remove excess fluid from the nozzle tip. A high amplitude pulse (xx Hz, yy V) that causes the material build-up at the nozzle tip to be removed.

Figure 6:
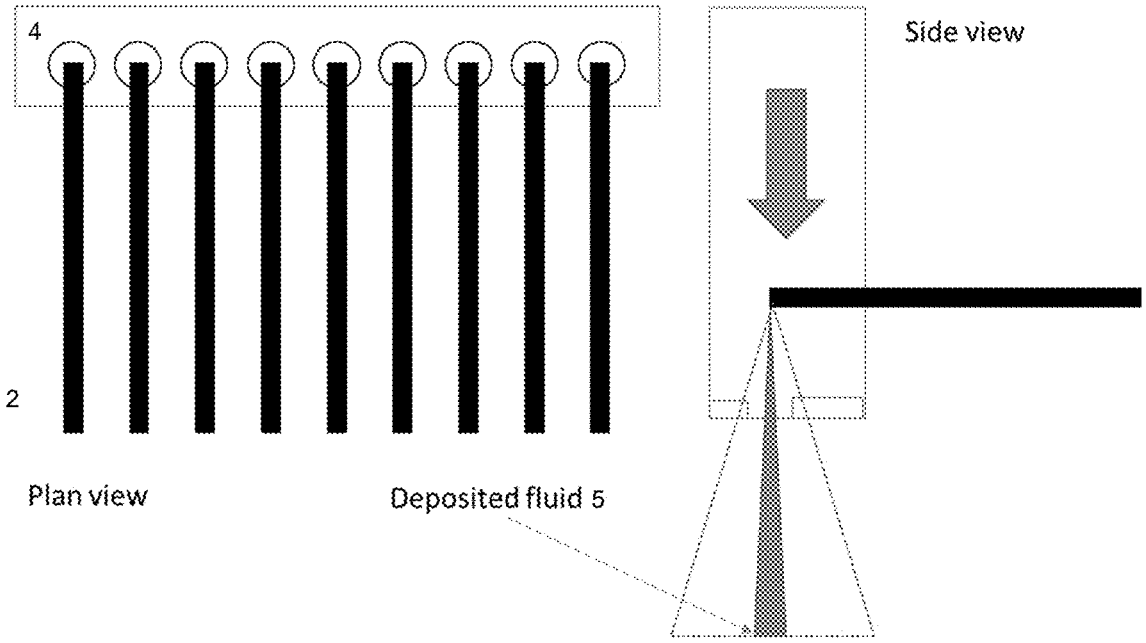
FIG. 6 shows of external to focus deposited fluids.

FIG. 6 illustrates a fifth example defining a multi-orifice plate 4 chamber printhead design 1 using external fluid flow 5 to direct deposition. Gas flow is applied to the dispense orifice via the chamber 3 to create an air flow that reduces the spread of the dispensed fluid such that the resolution of the deposited fluid features is increased. The velocity of the air flow can be controlled to achieve the desired resolution, and it is possible to use the air flow to direct the dispensed fluids.

A sixth example defines flow channels with perpendicular piezoactuators to control deposition width. Flow channels actuated by a multiplicity of piezoactuators attached to the needle, in the preferred embodiment there are two piezoactuators attached perpendicular to the flow channel, enabling control of the flow channel perpendicular to the direction of the substrate onto which fluids are being deposited.

This enables several elements of resolution control to be achieved: fixed offsets perpendicular to the substrate travel direction of individual nozzles in an array 2; oscillation perpendicular to the substrate travel direction.

Figure 7:
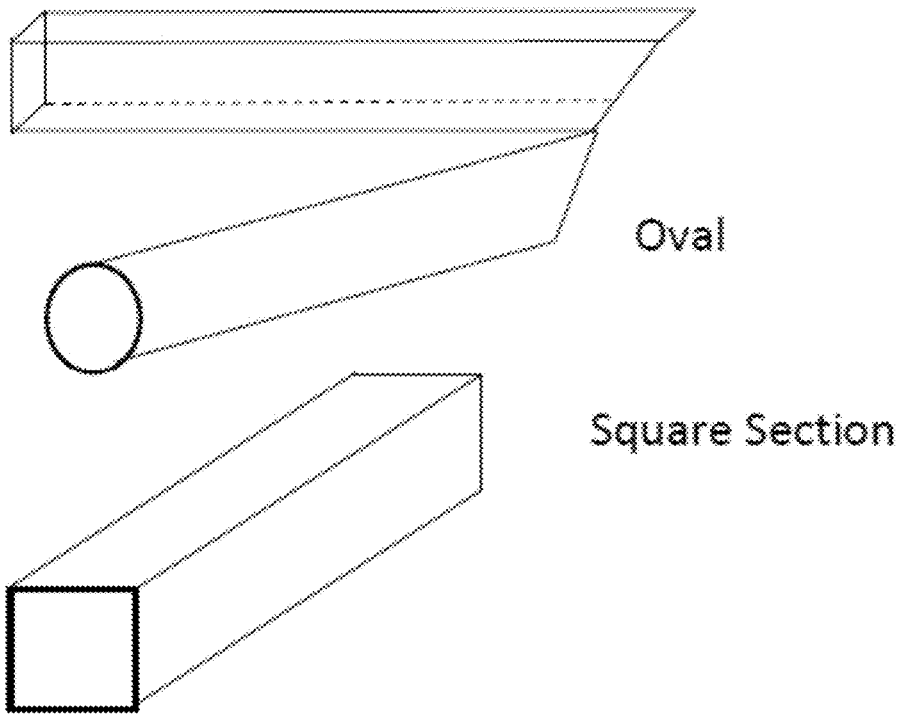
FIG. 7 shows cross-sections of the flow channel to minimise off-axis movement.

FIG. 7 illustrates a seventh example defining flow channel cross-sections to minimise movement perpendicular to the excitation direction. Known in the art is circular cross section flow channels for piezo-actuated liquid deposition. These cross sections, while suitable for the purpose of liquid transport do not eliminate off axis (the axis defined as the plane parallel to the piezo actuator and nozzle tip) vibrational modes of excitation. These off axis vibrations can limit precision of the droplet formation and hence the resolution of the deposited materials.

This invention refers to non-circular cross sections, which enable mechanical control of the piezo-actuator excitation such that off-axis movement is minimised. We refer in this invention specifically to oval, square, triangular section flow channels and variations therein, which are intrinsically stiffer in off axis directions than a circular cross section of comparable wall thickness.

1. This invention also refers to external flow channel structures that are mechanically linked to the flow channel such as ribs, which stiffen the flow channel in off-axis directions to minimise unwanted displacement of the orifice.
2. This invention also refers to butted tubes with variable wall thickness.
3. Claims:
4. Flow channel geometries for piezo actuated liquid deposition that reduces off axis vibrations compared to a circular cross section
5. Flow channel cross sections comprising, oval, square, triangular cross sections
6. Flow channel cross sections comprising external features that add stiffness in off-axis directions, such as ribs and gussets FIG. 8 illustrates an eighth example defining an interdigitated array of dispenser flow channels 2. An array of needles that is interdigitated with an opposing array of needles, where the resolution is doubled by adding the opposing row of needles. The arrays are controlled by the same software signals, enabling a higher resolution image to be created.

FIG. 9 illustrates a ninth example defining tapered flow channel cross-sections for high viscosity fluids. Description: A piezo driven needle, wherein the flow channel reduces in cross sectional area from inlet to outlet. The cross sectional area reduction is designed to minimise the flow resistance of the tube such that higher viscosity fluids can be transported using the same outlet orifice dimensions.

Known in the art is a single piezo-actuated flow channel with constant cross sectional area. However, the fluids that can be transported by this design are limited in viscosity by the overall flow resistance of the channel, which is determined by the cross-sectional geometry required at the outlet for the piezo actuation liquid deposition process to occur. It is known that the channel is filled via capillary flow and that the pressure required is inversely proportional to channel diameter to the third power. Hence it is desirable to reduce the channels flow resistance to enable high viscosity liquids to be transported by capillary flow.

This design is based on the concept that the flow channel is tapered to allow both reduced flow resistance and maintain the required outlet geometry for piezo-actuated liquid deposition to occur. It is known that an outlet geometry with a larger cross sectional area does not enable piezo actuated liquid deposition.

A further embodiment of this concept utilises a constriction of the orifice cross section itself to minimise area of the meniscus, such that statistical variation of the meniscus geometry is minimised.

A tenth example defines a rifled flow channel to reduce resistance to flow in the channel.

FIG. 10 illustrates an eleventh example defining a continuous flow configuration for high viscosity fluids. The chamber 3 includes an area of the nozzle plate 4 that is connected back to the ink system via a recirculating pump. The dispensed ink flow can be redirected to dispense via one of the following mechanisms: i) air flow; ii) piezo; iii) electrostatic.

The invention claimed is:

1. An industrial printhead for dispensing a fluid, the printhead comprising an array of piezoactuated flow channel dispenser needles, each needle having an orifice with a nozzle tip to allow the fluid to be dispensed, the flow channel dispenser nozzle tips being enclosed in a chamber, and the chamber comprising a multi-orifice plate which is spaced from the flow channel dispenser nozzle tips, the multi-orifice plate allowing the fluid which has exited the nozzle tips to exit the chamber, whereby the fluid to be dispensed flows through the flow chamber dispenser needles, into and through the flow channel dispenser nozzle tips, into the chamber, and from the chamber through an orifice in the multi-orifice plate, the chamber being filled with a gaseous fluid of known composition which is saturated with vapour of the fluid to be dispensed thereby minimising evaporation at the nozzle tips, and wherein the array of flow channel dispenser needles is attached to a plurality of piezoactuators configured to actuate the flow channel dispenser needles in a direction perpendicular to the flow channel, so that the fluid exits through the multi-orifice plate in a direction perpendicular to a direction of flow through the flow channel dispenser needles.

2. The industrial printhead according to claim 1 wherein the chamber is filled with a fluid of known flow profile.

3. The industrial printhead according to claim 1 wherein the gaseous fluid of known composition is introduced to the chamber as a continuous flow which is directed parallel to the deposited fluid flow to minimize spreading of the deposited fluid flow.

* * * * *